US005661495A

United States Patent [19]

Saldell

[11] Patent Number: 5,661,495

[45] Date of Patent: Aug. 26, 1997

[54] ANTENNA DEVICE FOR PORTABLE EQUIPMENT

[75] Inventor: Ulf Saldell, Österskär, Sweden

[73] Assignee: Allgon AB, Akersberga, Sweden

[21] Appl. No.: 331,556

[22] PCT Filed: Apr. 29, 1994

[86] PCT No.: PCT/SE94/00391

§ 371 Date: Apr. 24, 1995

§ 102(e) Date: Apr. 24, 1995

[87] PCT Pub. No.: WO94/28593

PCT Pub. Date: Dec. 8, 1994

[30] Foreign Application Priority Data

May 24, 1993 [SE] Sweden ..... 9301761

[51] Int. Cl.[6] ..... H01Q 1/24

[52] U.S. Cl. ..... 343/702; 343/725; 343/895

[58] Field of Search ..... 343/702, 895, 343/901, 725; H01Q 1/24

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson | 343/702 |
| 5,204,687 | 4/1993 | Elliott et al. | 343/702 |
| 5,262,792 | 11/1993 | Egashira | 343/702 |
| 5,317,325 | 5/1994 | Bottomley | 343/702 |
| 5,446,469 | 8/1995 | Makino | 343/702 |
| 5,479,178 | 12/1995 | Ha | 343/895 |

FOREIGN PATENT DOCUMENTS

| | | |
|---|---|---|
| 0 516 490 A2 | 12/1975 | European Pat. Off. . |
| 0 467 822 | 1/1992 | European Pat. Off. . |

*Primary Examiner*—Michael C. Wimer

*Attorney, Agent, or Firm*—Jacobson, Price, Holman & Stern, PLLC

[57] ABSTRACT

An improved antenna device for small size portable communication equipment comprising circuits (23) for transmitting and/or receiving radio signals as well as a chassis (25) and a feeding point (22) providing the electrical coupling of the antenna device to the communication equipment. The antenna device comprises a hollow helical antenna (6) fixed externally on the chassis and an antenna rod slidable through the helical antenna and being part of a straight radiator (1). The helical antenna (6) is of quarter-wave type and is coupled constantly via the feeding point (22) to the circuits (23). The straight radiator (1) is a quarter-wave radiator and the antenna device is provided with a switching device (2, 12, 13), which couples via the feeding point (22) the quarter-wave radiator (1) to the circuits (23) in parallel with the helical antenna (6) when the antenna rod is extended, while the switching device (2, 12, 13) substantially decouples the quarter-wave radiator from the circuits (23) and the feeding point (22) when the antenna rod is retracted.

4 Claims, 3 Drawing Sheets

FIG. 2
FIG. 3
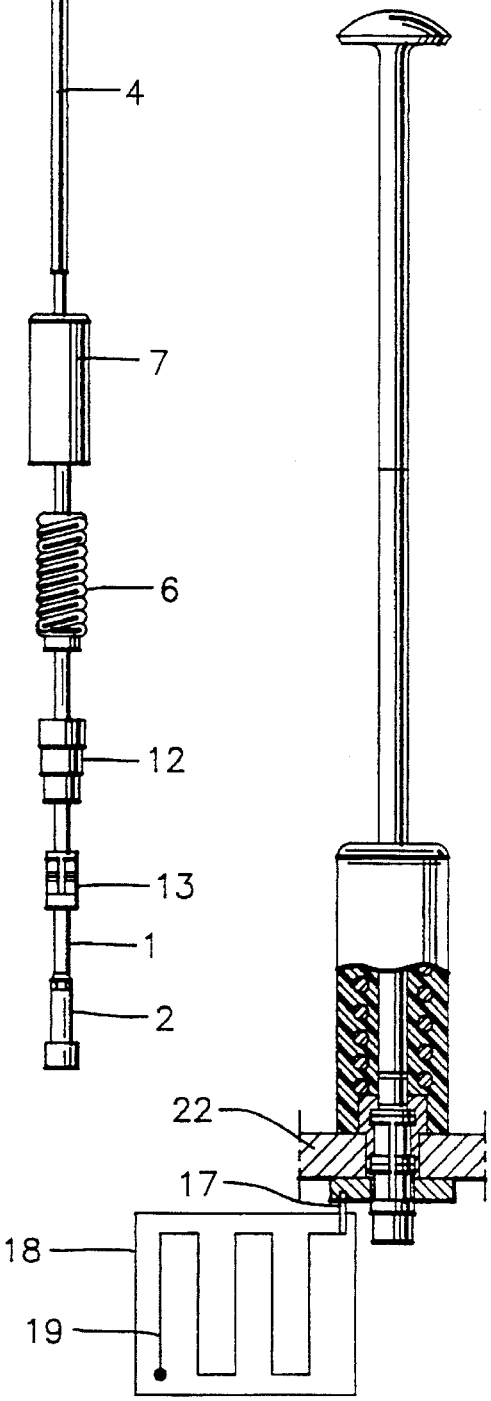
FIG. 4
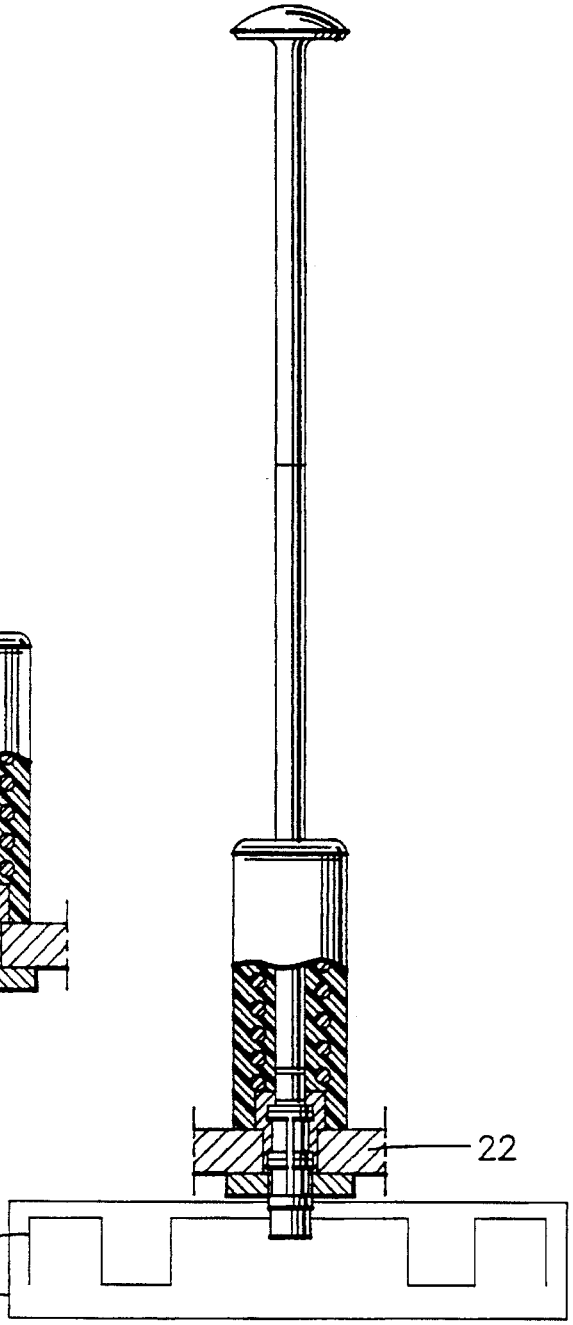

ANTENNA DEVICE FOR PORTABLE EQUIPMENT

BACKGROUND OF THE INVENTION

The present invention relates to an antenna device for portable communication equipment, specifically for hand portable telephones, comprising circuits for transmitting and/or receiving radio signals as well as a chassis and a feeding point providing the electrical coupling of the antenna device to the communication equipment, the antenna device comprising a hollow helical antenna fixed externally on the chassis and an antenna rod slidable through the helical antenna, which antenna rod includes a substantially straight radiator.

Antennas for hand-portable telephones may be divided generally into two main groups, quarter-wave and half-wave radiators, although types somewhere between and outside these may occur.

Characteristics of a quarter-wave radiator are:

- the length of its actively radiating portion is one quarter of a wavelength (radiating portion length approximately 8 cm at 900 MHz),
- its feeding connection impedance is low, which allows its direct connection to the 50 Ohm impedance of the telephone, without impedance transformation,
- due to its short length a 900 MHz telephone user will not consider it disturbing,
- it is dependent on a ground plane for its function.

Characteristics of a half-wave length radiator are:

- the length of its actively radiating portion is one half of a wavelength (radiating portion length approximately 16 cm at 900 MHz),
- its feeding connection impedance is high, which requires impedance transformation to the 50 Ohm impedance of the telephone,
- it is unsuitable for use in a small telephone due to its total length of 18–20 cm including a connector,
- it is independent of a ground plane for its function.

In the specification and claims below the terms half-wave radiator and quarter-wave radiator refer to antennas having substantially the above characteristics, respectively.

A straight radiator mounted on the outside of the chassis of a hand portable telephone occupies considerable space and is exposed to strain which, for example can result in breaking. Further, only lower antenna performance is required when no call is going on. For this reason, the straight radiator is often made retractable and is combined with a helical antenna having lower antenna performance, but being considerably less bulky.

U.S. Pat. No. 4,868,576 describes an antenna device of the aforementioned type, the device comprising a retractable capacitively coupled half-wave radiator in combination with a helical antenna of half-wave type. This known device solves the above problem for a telephone of large size, but is dependent on a half-wave radiator to provide satisfactory antenna performance. However, the physical dimensions of modern hand portable telephones are so small that a half-wave radiator would be very difficult to fit therein lengthwise, without providing with a complicated telescopically retracting feature. It is also lacks an aesthetically pleasing appearance since its length is out of proportion to the small size of modern telephones.

Further, the half-wave radiator requires an impedance transformer taking up room inside the telephone and causing higher costs due to additional components.

The European Patent Application 0 467822 A2 discloses another antenna system for a hand portable telephone comprising a retractable quarter-wave radiator provided in its upper end with a helical antenna of the quarter-wave type, which substantially has no coupling to the quarter-wave radiator. The quarterwave radiator is only connected in the fully extended position and the helical antenna only in the fully retracted position. This systems solves the above-mentioned problem for a small-size telephone, but has the drawback of the telephone completely lacking antenna function as soon as the retractable quarterwave radiator is not in one of its end positions. Besides, it is both an aesthetic and a strength drawback to provide the helical antenna in the upper end of the quarter-wave radiator.

SUMMARY OF THE INVENTION

An antenna device of the above mentioned type according to the invention meets the demands for small antenna size, antenna function during extension and retraction as well as simple and durable design. The invention is characterized in that the helical antenna is of quarter-wave type and is coupled constantly via the feeding point to the circuits, in that the straight radiator is a quarter-wave radiator and in that the substantially antenna device is provided with a switching device, which couples via the feeding point the quarter-wave radiator to the circuits in parallel with the helical antenna when the antenna rod is extended, while the switching device substantially decouples the quarter-wave radiator from the circuits and the feeding point when the antenna rod is retracted.

In a preferred embodiment of the invention, the switching device comprises a lower part of the quarter-wave radiator, a sleeve connected to a feeding point and a flexible contact part arranged inside the sleeve, the contact part interconnecting the quarter-wave radiator and the sleeve when the antenna rod is extended. The switching device may further be arranged so as to also serve as mechanical locking means for the quarter-wave radiator in its extended position.

Some telephone systems are so broad-banded that a helical antenna gives insufficient performance. To solve this problem a low impedance transmission line is connected in parallel at the feeding point, the transmission line e.g. being arranged on a flexible board of low-loss type and having a thickness of only a few hundredth of a millimeter.

In order to make the antenna function substantially independent of the telephone being touched, the above mentioned antenna system may be combined with a tuned ground plane, so that the mirror currents of the antenna flow in this tuned ground plane instead of in the chassis of the telephone. The tuned ground plane may, for example, be formed on a separate flexible board or as a pattern integrated in the chassis or the circuit board of the telephone.

It is possible to obtain the above-described characteristics with either galvanical or non-galvanical low impedance coupling of RF-signals e.g. between the quarter-wave radiator and the helical antenna/the transmission line/the circuits and/or between the helical antenna/the quarter-wave radiator and the transmission line/the circuits (see FIGS. 5A, 5B).

BRIEF DESCRIPTION OF THE DRAWINGS

The invention will be described below in the form of different embodiments with reference to the attached drawings, wherein:

FIG. 2 shows in an exploded view of parts of the antenna device of FIG. 1A.

FIG. 3 shows the antenna device of FIG. 1A in combination with a transmission line connected thereto.

FIG. 4 shows the antenna device of FIG. 1A combined with a tuned ground plane connected thereto.

DESCRIPTION OF THE PREFERRED EMBODIMENTS

Figure 1A:
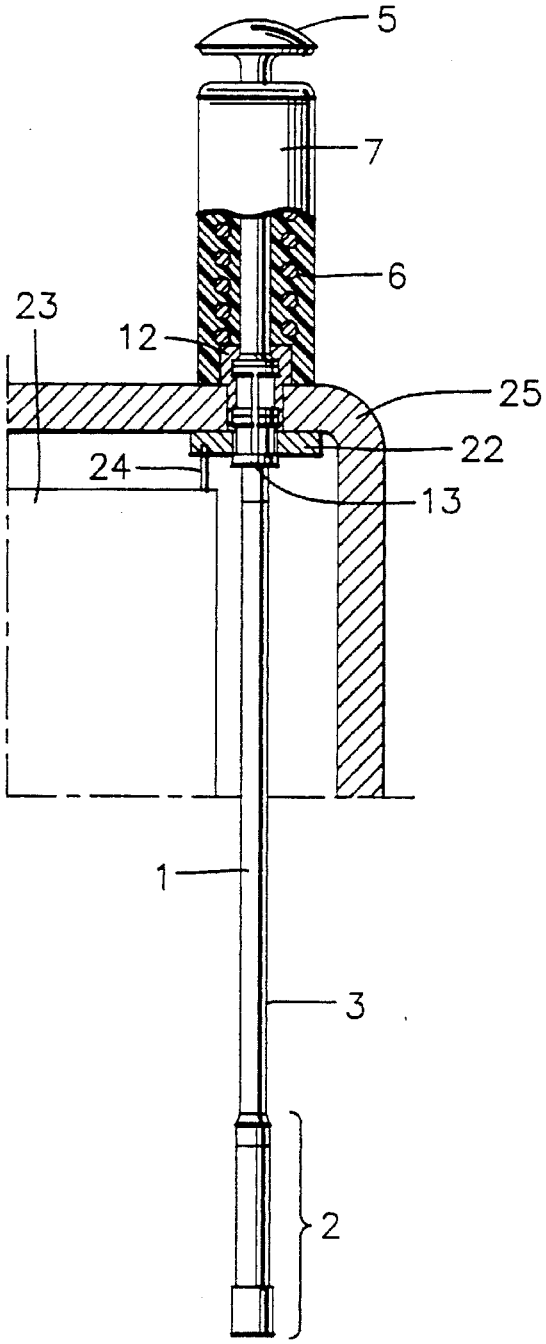
FIG. 1A shows partially in cross section a view of an embodiment of the antenna device of the invention, wherein an antenna rod is in the retracted position.
Figure 1B:
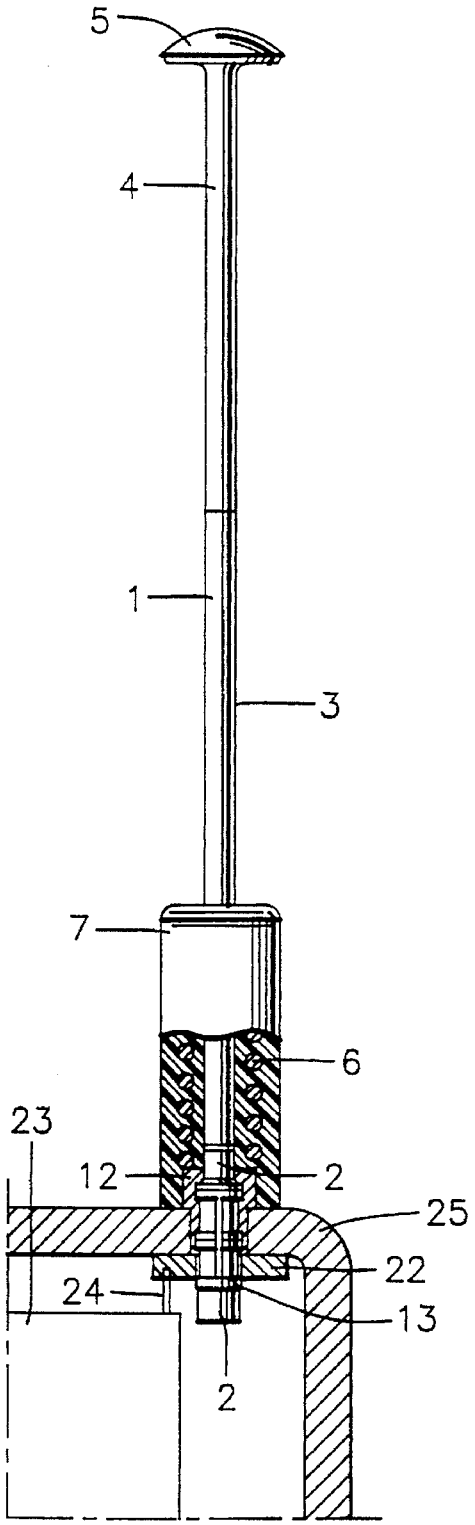
FIG. 1B shows partially in cross section a view of the embodiment of FIG. 1A, but with the antenna rod in the extended position.

The antenna device shown in FIGS. 1A, 1B and 2 is arranged externally on the insulating chassis 25 of a hand portable telephone and consists of two main components. The first main component is a quarterwave radiator 1 (rod antenna), the lower end of which is bare to facilitate further galvanic coupling, while it is otherwise provided with an insulating casing 3, and the upper end of which is attached to an upper part 4 made of insulating material. The quarter-wave radiator and the upper part together form an antenna rod, which is preferably provided with a knob 5 in its upper end. The second main component is a helical antenna 6 of quarter-wave type, which is moulded into a casing 7 made of protective, insulating material, which in its lower end has a fastened sleeve 12 made of conducting material. The sleeve 12, which is in contact with a feeding point 22 of the quarter-wave radiator and the helical antenna, and with a bridge 24 to circuits 23 of the hand portable telephone, is mechanically and galvanically coupled to the lower end of the helical antenna 6 and contains a flexible contact part 13. The antenna rod 1 is movably arranged through the helical antenna 6, the casing 7, the sleeve 12 and the contact part 13.

The above mentioned parts are substantially symmetrically arranged with regard to the central length axis of the antenna rod. The sleeve 12 is also part of the fastening means of the antenna device to the chassis 25 of the hand portable telephone. Preferably, a protective, insulating tube (not shown) is attached on the underneath side of the sleeve 12, into which tube the antenna rod travels when retracted through the sleeve 12.

Figure 5A:
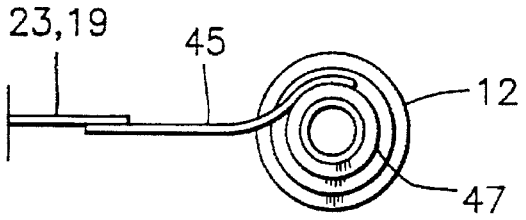
FIGS. 5A–C are two views and one schematic representation of a first alternative way of providing couplings between a helical antenna, a quarter-wave radiator, and, possibly a transmission line/circuits for transmitting and/or receiving contained in an antenna device according to the present invention.
Figure 5C:
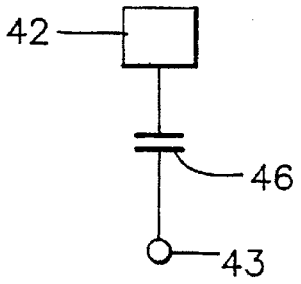
Figure 5B:
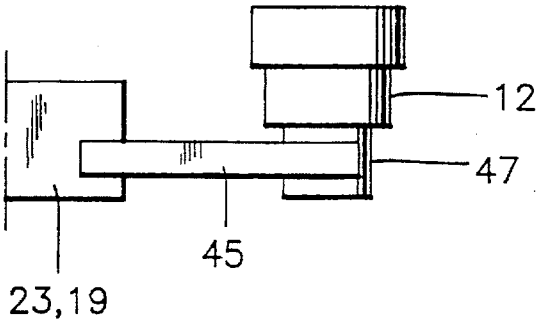

According to the example shown in FIG. 5A–5C, a coupling is obtained between the sleeve 12, which is interconnected with the helical antenna, and the circuits 23/the transmission line 19, by means of a conductive, flexible reed 45 connected to the circuit 23/the transmission line 19 and being in close contact with the lower part of the sleeve 12, said lower part being provided with a thin insulating layer 47. The coupling in this case is capacitive and the corresponding capacitance is inversely proportional to the thickness of the insulating layer 47 and directly proportional to the permittivity of the layer and to an area defining adjacent areas of the lower part of the sleeve 12 and the flexible reed, respectively. The desired capacitance of the coupling is obtained through an appropriate choice of the mentioned parameters. In the eqivalent circuit diagram of FIG. 5C, the capacitor created according to the above is indicated by 46, the sleeve 12 by a block 42, and a connection to the circuits 23/the transmission line 19 by the point 43.

In hand portable telephones, transmitting and receiving takes place as well when no call is going on. In this case the antenna rod is normally completely retracted, so that its upper, non-conductive part 4 is located inside the helical antenna 6. When so arranged the quarter-wave radiator is galvanically and substantially and capacitively separated from the helical antenna 6, the latter effecting the total antenna function.

During a call, or when otherwise required with regard to antenna performance, the quarter-wave radiator 1 is extended, its lower part 2 being galvanically or capacitively coupled, via the sleeve 12 and the contact part 13, in parallel with the helical antenna 6, via the feeding point 22 and the bridge 24 to the circuits 23 of the hand portable telephone. In this case the antenna function is substantially the same as that of the quarter-wave radiator 1 alone.

Thus the coupling and decoupling of the quarter-wave radiator 1 is effected by extending and retracting the antenna rod 1, respectively. Extension of the antenna rod is limited by the lower part 2 of the quarter-wave radiator being stopped by the contact part 13 and the sleeve 12. The contact part 13 also serves as a mechanical locking mechanism for the antenna rod in its extended position, while its retracting movement is limited by e.g. the knob 5 or a bottom of the aforementioned insulated tube.

Figure 5D:
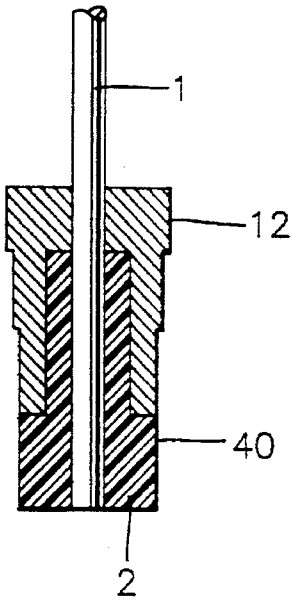
FIGS. 5D–E are a cross sectional view and a schematic representation of a second alternative way of providing couplings between a helical antenna, a quarter-wave radiator, and, possibly, a transmission line/circuits for transmitting and/or receiving contained in an antenna device according to the present invention.
Figure 5E:
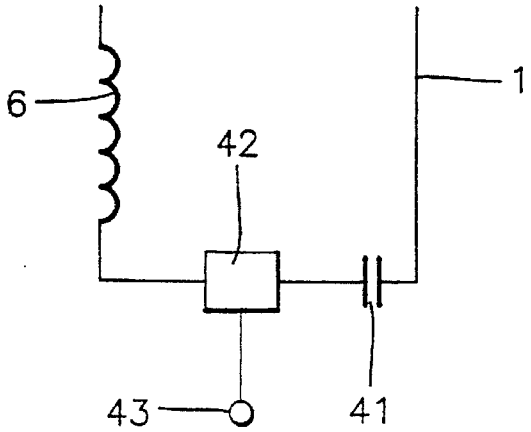

According to the example shown in FIGS. 5D–5E, a coupling may be obtained between the quarter-wave radiator 1, in its extended position, and the sleeve 12, through providing the lower end 2 of the quarter-wave radiator 1 with a thin insulating layer 40. The coupling in this case between the quarter-wave radiator 1 and the sleeve 12 is capacitive. The corresponding capacitance is inversely proportional to the thickness of the insulating layer 40 and directly proportional to the permittivity of the layer and to an area defining adjacent areas of the sleeve 12 and the lower part 2, respectively. Since a high capacitance is desirable for this coupling, the parameters are selected accordingly. In the eqivalent circuit diagram of FIG. 5E, the capacitor created according to the above is indicated by 41, the sleeve 12 by a block 42, the helical antenna and the quarter-wave radiator by the symbols 6 and 1, respectively, and a connection to the circuits 23/the transmission line 19 by the point 43.

FIG. 3 shows the antenna device of FIG. 1 in combination with a low impedance transmission line in the form of a flexible laminate 18 provided on one side with a conductor 19 having two ends, wherein the first end is connected via a bridge 17 to the conductive sleeve 12 and the second end is coupled via a lead-through to a ground plane arranged on the other side of the flexible laminate 18, the ground plane being in contact with the signal ground of the telephone. This design may be used to meet the requirements in telephone systems that are so broad-banded that one helical antenna alone is not suitable as an antenna. The low impedance transmission line is coupled in parallel with the helical antenna via the feeding point 22 and the sleeve 12.

FIG. 4 shows the antenna device in FIG. 1 in combination with a mirror-symmetrical ground plane in the form of a flexible board 20 provided with a conductor 21, the middle of which is coupled to the protective earth of the telephone. However, the conductor is not in direct galvanical connection with the sleeve 12. The tuned ground plane permits the antenna function to be independent of contact with the chassis of the telephone. This is a result of the mirror currents of the antennas flowing in the tuned ground plane instead of, e.g., in the chassis of the telephone. The tuned ground plane can be formed by a separate flexible board or as a conductive pattern integrated in the chassis or the circuit board of the telephone.

I claim:

1. An antenna device for portable communication equipment comprising circuits for transmitting and/or receiving radio signals as well as a chassis and a feeding point providing the electrical coupling of the antenna device to the communication equipment, said antenna device comprising a hollow helical antenna fixed externally on the chassis and an antenna rod slidable through the helical antenna, which antenna rod includes a straight radiator, said helical antenna being a quarter-wave antenna element coupled constantly via the feeding point to the circuits, said straight radiator being a quarter-wave radiator, said antenna device being provided with a switching device which conductively couples via the feeding point said straight radiator to the circuits in parallel with the helical antenna when the antenna rod is extended, while the switching device substantially decouples said straight radiator from the circuits and the feeding point when the antenna rod is retracted, wherein said switching device comprises a lower part of said straight radiator and a conductive sleeve placed at and being connected to the feeding point, said sleeve having a flexible contact part which intercouples said straight radiator and the sleeve when the antenna rod is extended.

2. The antenna device as claimed in claim 1 wherein said switching device serves as mechanical locking means for said straight radiator in its extended position.

3. The antenna device as claimed in claim 1 wherein a transmission line is connected to the feeding point in order to increase the bandwidth of said helical antenna.

4. The antenna device as claimed in claim 1 wherein a tuned ground-plane is arranged adjacent to the feeding point without making direct galvanical contact thereto, said ground plane being coupled to the protective earth of the communication equipment and being capable of taking up mirror currents.

* * * * *